United States Patent [19]

Hensel et al.

[11] Patent Number: 4,790,595

[45] Date of Patent: Dec. 13, 1988

[54] CHAIR HAVING SEAT AND BACK CAPABLE OF RELATIVE TILTING

[75] Inventors: Willi Hensel, Willingen; Jurgen Lange, Grafenau; Reinhard Paulus, Cologne, all of Fed. Rep. of Germany

[73] Assignee: Mauser Waldeck AG, Waldeck, Fed. Rep. of Germany

[21] Appl. No.: 40,678

[22] Filed: Apr. 21, 1987

[30] Foreign Application Priority Data

Apr. 21, 1986 [DE] Fed. Rep. of Germany ..... 3613381
Oct. 4, 1986 [EP] European Pat. Off. ..... 86113762.8

[51] Int. Cl.[4] ..... A47C 3/00

[52] U.S. Cl. ..... 297/285; D6/380; 297/302

[58] Field of Search ..... 297/302, 300, 301, 285, 297/353, 354, 452, 445, 454, 318; D6/374, 375, 380, 366

[56] References Cited

U.S. PATENT DOCUMENTS

| | | | |
|---|---|---|---|
| D. 289,120 | 4/1987 | Chadwick et al. | D6/380 |
| 1,912,576 | 6/1933 | Gazarian | 297/318 |
| 4,047,757 | 9/1977 | Eames et al. | 297/460 X |
| 4,529,247 | 7/1985 | Stumpf et al. | D6/366 X |
| 4,575,150 | 3/1986 | Smith | 297/300 |

FOREIGN PATENT DOCUMENTS

| | | | |
|---|---|---|---|
| 1032914 | 7/1953 | France | 297/302 |

*Primary Examiner*—James T. McCall
*Attorney, Agent, or Firm*—Pennie & Edmonds

[57] ABSTRACT

Chair having seat and back parts capable of springy tilting relative to each other. The seat and back parts are provided in the region where they join each other with a reduced width to intensify the relative tilting thereof. Longitudinal slots are also provided in the seat and extend from the region of reduced width to further intensify this relative tilting.

The chair frame is provided with fastening elements in the region of the front edge of the seat for tilting attachment of seat and back.

14 Claims, 4 Drawing Sheets

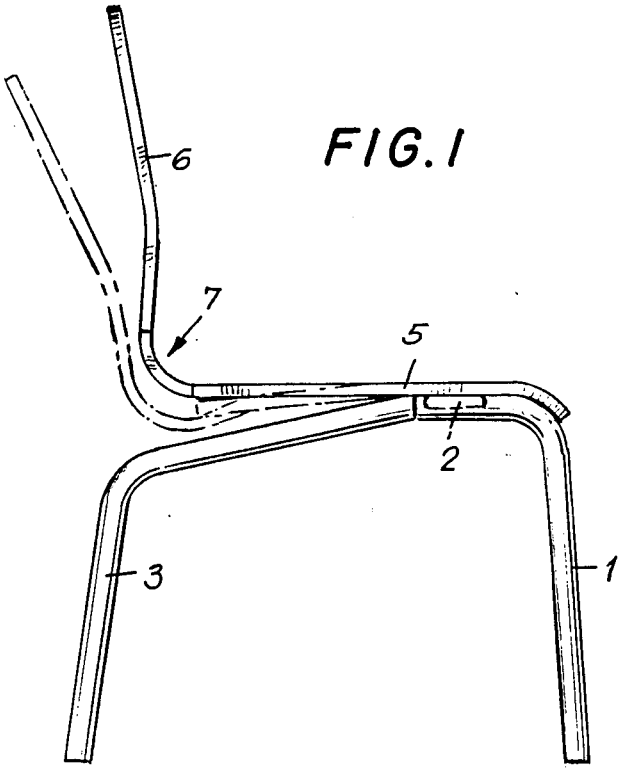
FIG. 1
FIG. 2
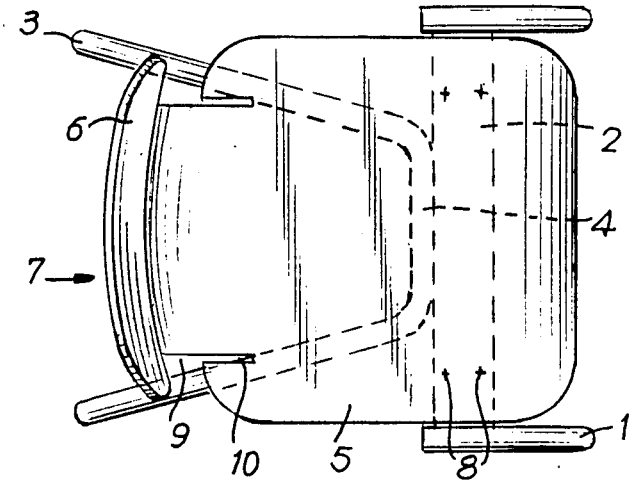

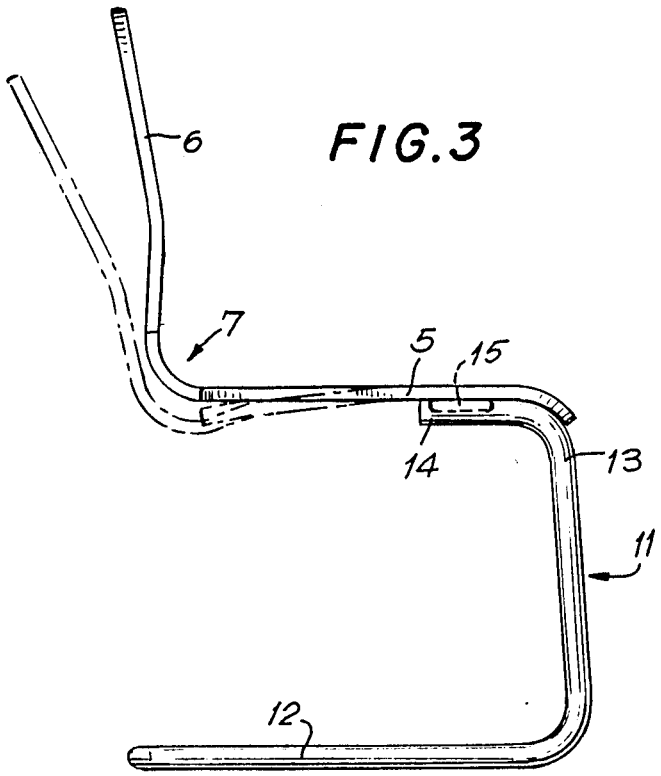
FIG. 3
FIG. 4
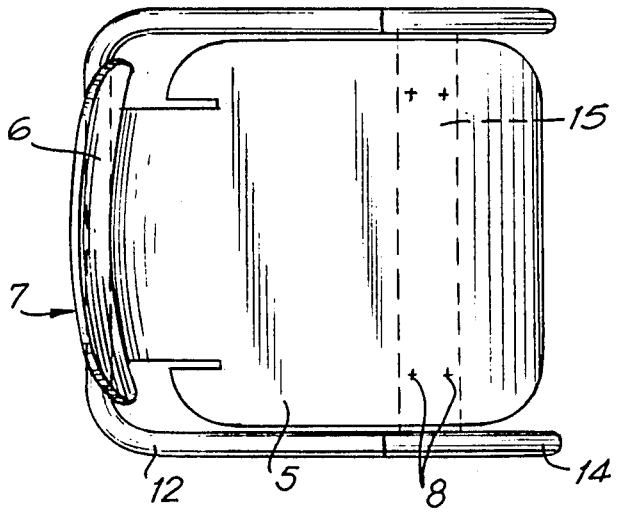

CHAIR HAVING SEAT AND BACK CAPABLE OF RELATIVE TILTING

FIELD OF THE INVENTION

The invention concerns a chair whose frame is provided with fastening elements for attachment of the seat and back parts of the chair with the seat and back being capable of moving springily toward one another. The frame structure may also tiltingly support the seat part of the on the frames.

BACKGROUND OF THE INVENTION

Prior art chairs having a seat bucket consisting of a seat part and back part (DE-GM 75 00 152) with a recess in the seat bucket are known. The recess in these constructions includes a laterally extending slot arranged approximately parallel to the front edge of the seat and lying in the back part at the approximate region of the transition to the seat part. Two additional slots running approximately perpendicular from this slot toward the front of the seat part are provided so that the recess has approximately the shape of a U. Owing to this, a tilting of the back part about a horizontal axis extending through the front end points of the slots running in the sitting direction is effected. However, since the main laterally extending slot forming the base of the U extends over the whole width of the seat, the slot concerned must be covered by an elastic overlay if bruising of the buttocks of the person sitting on the chair is to be prevented. Such a slot design can therefore not be used for a bucket structure without additional padding or the like.

In known swivel chairs (DE-GM 84 01 000) the seat, in the region of its front as well as of its rear end, is capable of tilting about axes aligned parallel to the front and back seat edges. In these constructions the back of the chair is formed separately from the seat and is capable of tilting in itself in such fashion that the so-called angular opening of the seat, that is, the angle between the seat and the back is variable within relatively wide limits when the person sitting on the chair changes his position, for example, when moving from a straight sitting posture to a position leaning far backward. Ergonomic studies have shown that this is particularly favorable for counteracting symptoms of fatigue in that the spinal column is effectively supported by the back of the chair in all sitting positions. Such a chair, however, has a relatively complicated and costly structure. For example, the seat and back must be connected separately on the chair frame. Also, a plurality of axes of rotation, in some cases with slot guidance and spring return elements, is necessary in the region of the front and back ends of the seat and because of these features a correspondingly complicated and costly chair frame becomes necessary.

Also known are so-called free-swinging chairs, that is, those in which the frame, seat and back are formed of continuous springy tubular sections which with a simple structure do indeed permit a relatively good adaptation to various sitting postures, but yet at the same time are disadvantageous in so far as when a person occupying the chair leans far backward. When this happens, the region of the front edge of the seat is displaced backward and downward and thereupon likewise the position of the person with respect to surrounding pieces of furniture, particularly table tops. In addition, variation of the angular opening of the seat is limited and a bucket-shaped design of chair and back is not possible.

BRIEF DESCRIPTION OF THE INVENTION

In accordance with the teachings of the present invention, the flexible displaceability between the seat and back is provided by a reduction of the cross section in the flexible transition region between the two. Such an intensification of flexible displaceability results in an appreciable increase in the angular seat opening between the seat and back parts when leaning far backward and is very desirable for leaning back comfortably and thereby obtaining secure support.

The advantages of the invention come to bear in particularly simple and favorable fashion when the seat and back parts are designed integrally as a one-piece bucket seat and constructed of such materials as plywood, metal or synthetic material. A horizontal unilateral indentation or a bilateral waistlike constriction of the bucket seat is provided for reducing the lateral width or cross section, as is frequently now customary in chairs having a one-piece seat and back bucket whose seat is attached nontilting to the chair frame.

In a bucket seat having a constricted waistlike width in the region connecting the back and seat part or in a bucket type seat with slots aligned transverse to the direction of sitting, further intensification of the flexible displaceability of the back seat parts relative to each other is obtainable in particularly simple fashion by forming notches or slots in the seat part. These slots start from the end of the waistlike constriction or transverse slots and run forward in sitting direction. In this way, the back is able to tilt with respect to the seat about practically a horizontal axis extending through the front end points of the slots running in the sitting direction, which naturally produces a correspondingly great increase in the angular opening of the seat when the seated person leans backward.

A particularly structurally simple chair design is obtained according to the teachings of the present invention when flexibly fixing of the one-piece bucket seat to the chair frame at the front end of the seat part. A crosspiece attached to the chair frame provides the connection. The crosspiece may be formed of a plate arranged essentially horizontally so as to obtain a suitably broad support surface of the bucket on the crosspiece. At the same time, it is then advisable to construct the upper back edge of the plate as a rounded off surface, so that upon tilting of the bucket no indentation is produced in the region of the bucket facing the upper back edge.

In a chair with four normal stationary legs, it is advisable to have back chair legs, running inclined from the crosspiece, branch off only slightly downward under the seat portion of the one-piece bucket in the region thereof, which legs are directed essentially perpendicular from the end of the seat part. In this way the back chair legs may be connected with the crosspiece in particularly simple fashion structurally and yet not hinder any downward tilting of the one-piece bucket in the region of the seat.

The chair frame, however, may alternatively be designed adjustable in height and/or rotary. At the upper end of a rotary telescopic part a fork-shaped fastening element having at least two prongs is provided. The free ends of the prongs extend to the front end of the seat part for the purpose of springy attachment of the seat part.

In a further embodiment of the present invention, a bracing member which is adjustable in sitting direction is provided between the seat and the prongs of the fastening element. A particularly simple construction is obtained when the displaceable bracing is designed as supporting rollers capable of rolling along on the prongs, the rollers being connected together by means of a common axle to which an actuating and locking means is connected. This design permits an accommodation of the springy or flexible properties of the chair to be varied according to the body weight of the person using the chair.

An additional bracing element may also provide for extending from the rotary telescopic part of the chair toward the underside of the rear region of the seat part. This is advantageous in cases where, in certain activities, a chair of the type concerned is to be limited to a predetermined flexibility, that is, the person using the chair cannot inadvertently tilt far backward. Since such chairs are generally equipped with an adjusting lever, capable of being tilted in vertical direction, for adjusting the height of seat and back parts, it is advisable to design the bracing element capable of retraction and extension through horizontal tilting of the said lever by means of interposed gear elements. This construction converts what is otherwise a tiltable bucket seat type of chair to one which is effectively attached firmly to the chair frame against backward tilting except for the tilting of the back part relative to the seat part.

BRIEF DESCRIPTION OF THE DRAWING

FIG. 1 is a side view of a particularly advantageous construction of a chair pursuant to the invention with a one-piece bucket defined by seat and back parts;

FIG. 2 is a top view of FIG. 1;

FIG. 3 is a side view of a chair with a seat and back pursuant to the invention and fixed to a free-swinging chair frame;

FIG. 4 is a top view of the chair of FIG. 9;

DESCRIPTION OF THE PREFERRED EMBODIMENT

Figure 5:
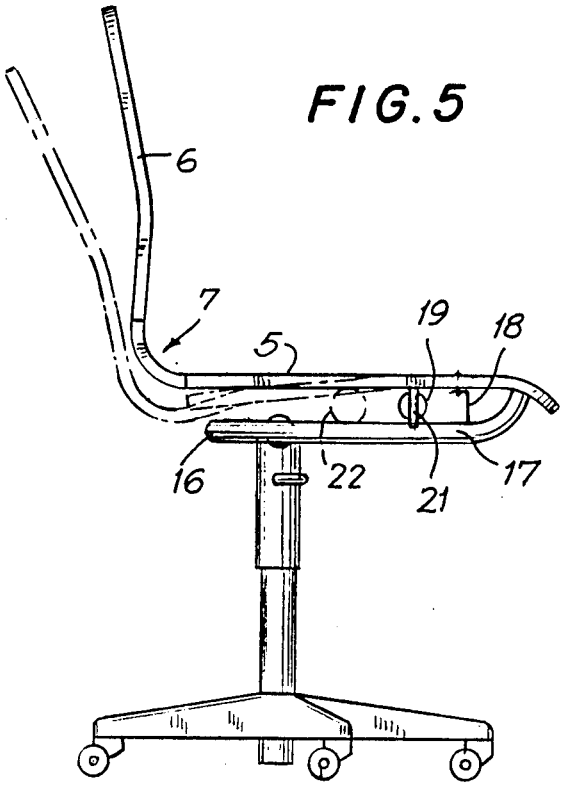
FIG. 5 is a side view of an alternative embodiment of the invention.

The chair of FIG. 1 has two front legs 1, formed of tubular sections, which are connected by a platelike crosspiece 2. The back chair legs 3 are connected to the crosspiece 2 by way of a connecting bar 4, specifically, preferably by welding. The back legs of the chair first run downward from the crosspiece 2 slightly inclined and at the back end of the chair are directed essentially vertically downwardly.

To the crosspiece 2 is attached a one-piece bucket seat 7 defined by the seat part 5 and back part 6. These parts are constructed of suitable springy or flexible material such as plywood, synthetic material or metal. The seat part is firmly fixed by means of fastening screws or rivets 8 to the crosspiece 2 so that the bucket 7 as a whole is displaceable yielding springily, while the part of the seat 5 lying in front of the crosspiece essentially retains its position. The back upper edge of the crosspiece 2 is advantageously rounded off so as not to produce any indentation in the back upper edge of the region facing the crosspiece 2 upon tilting of the region of the bucket lying behind or to the rear of the crosspiece.

Between the seat 5 and the back 6 of the bucket 7 is a bendable region designed waistlike constriction 9 having a width as measured from opposite sides of the chain which is less than the width of the seat end back parts. From the inner end of this constriction 9 longitudinal slots 10 run forward in the sitting direction in the seat 5 of the bucket 7. This, when the back 6 is stressed by a person leaning on it, the back 6 is capable of tilting about a horizontal axis with respect to the seat 5. This axis extends through the front ends of the notches 10.

In virtue of this design it may be seen that a twofold intensification of the springy displaceability existing in any case between seat 5 and back 6 of the bucket 7 is produced, specifically once owing to the waistlike constriction 9, but in addition particularly alternatively owing to the slots 10, running in the sitting direction, between seat 5 and back 6. Therefore, upon stressing of the back 6 when the person using the chair leans backward, an especially strong increase in the angular opening of the seat, that is, of the angle between seat 5 and back 6, is produced. This is very desirable for ergonomic reasons. As FIG. 1 shows, downward springing of the bucket 7 upon use of the chair is not hindered by the back chair legs because the latter, despite space-savings design, below the seat run downward slightly inclined correspondingly.

In the chair of FIGS. 3 and 4 the chair is designed with a so-called free-swinging chair frame 1, that is, a springy tubular frame which rests on the floor by a U-shaped base 12, the legs of the U-shaped base 12 continuing into essentially perpendicularly aligned front chair legs 13. In a conventional free-swinging chair the tubes 13, directed upward, are then further bent over double at essentially right angles to thus form the supporting structure for a seat and back. In the chair of FIGS. 3 and 4, however, the tubular parts 13, directed upward, are extended at the upper end by only another short piece 14 after being bent over into the horizontal. Between the tubular pieces 14 is attached, preferably by welding a crosspiece 15. To the crosspiece 15 is attached, in the same way as in the embodiment of FIGS. 1 and 2, the one-piece bucket 7 forming the seat and back and described there in detail and to which reference is made.

As may be seen, in this way a free-swinging chair frame may be provided with a bucket-shaped seat and back design, as is often desirable. At the same time, a particularly advantageous intensification of the springy displaceability between seat and back is obtained, as described in detail in the embodiment of FIGS. 1 and 2. In this connection, allowance must only be made for the fact that, by reason of the free-swinging chair frame, the front end of the seat, depending upon the variable stress owing to different sitting positions of the person using the chair, may be displaced in a circular path whose midpoint lies approximately at the lower end of the chair legs 11. However, in cases in which no other pieces of furniture, such as desks or the like, are directly coordinated with the chair in question, this generally plays no role.

Figure 6:
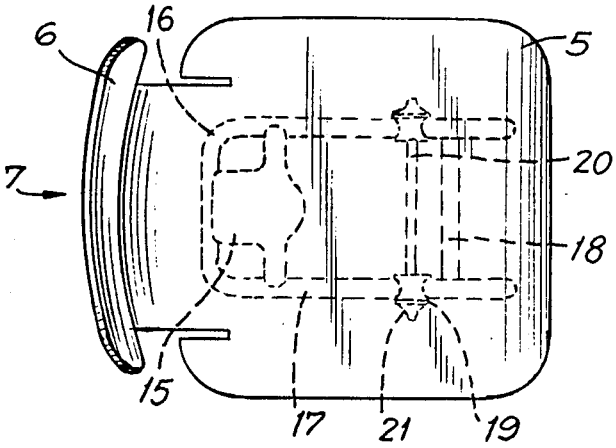
FIG. 6 is a top view of the chair of FIG. 5.

In the chair represented in FIGS. 5 and 6, a forklike fastening element 16 is made of a U-shaped tube running essentially horizontally, whose legs or prongs 17 are attached directly to the seat 5 at its front edge and in addition by means of a crosspiece 18. Capable of rolling along on the tubular prongs 17 is arranged a pair of rollers 19, which in adaptation to the section of the tubular prongs 17 have a concave external contour (see FIG. 6) and are connected together by an axle 20 and are displaceable by means of a grip 21 between the crosspiece 18 and an end position 22, shown by dashes in FIG. 5. A locking means, not shown, can be provided between grip 21 and the axle 20. The locking means is for example, axial motion of the grip 21, so that the rollers 19 are capable of being locked in any set position by the axle 20. As may be seen, bucket seat defined by the seat 5 and back 6 may in this way be optimally adjusted within relatively wide limits to the weight of a person using the chair. Instead, of the rollers 19, other suitable elements displaceable in sitting direction could of course alternatively be used.

Figure 7:
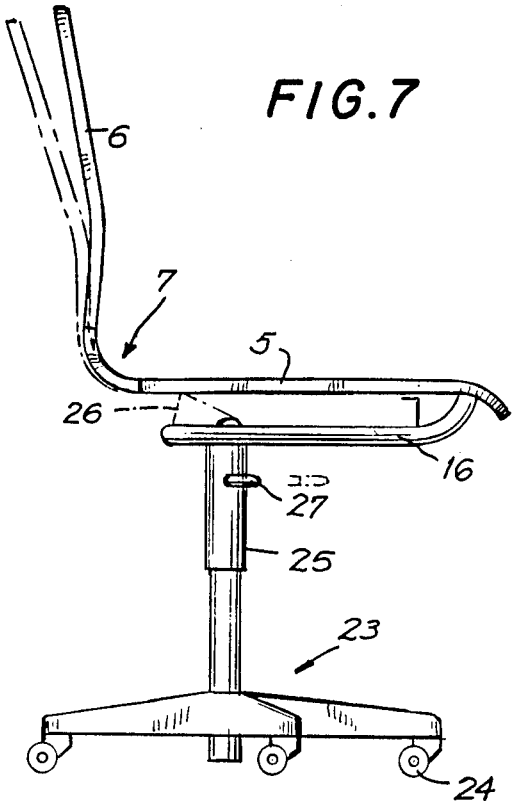
FIG. 7 is a side view of a chair, similar to that of FIGS. 5 and 6, with springiness of the seat capable of being cut out.
Figure 8:
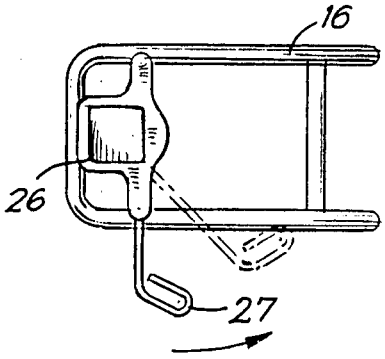
FIG. 8 is a top view of the chair of FIG. 7.

The chair of FIGS. 7 and 8 has a conventional height-adjustable swivel frame 23, which is capable of moving by means of casters 24. At the upper end of a rotary telescopic part 25 is arranged the forklike fastening element 16. The design of the forklike fastening element 16 is as in the chair of FIGS. 5 and 6, described previously, with the exception of the rollers 19 which are not provided here. In the chair of FIGS. 7 and 8, however, at the upper end of the rotary telescopic part 15 of the chair frame is providing a bracing element 26, which is capable of being extended by means of an adjusting lever 27. In the extended position this bracing element 26 engages against the underside 1 of the rear region of the seat 5, as is indicated by dashes in FIG. 7. The adjusting lever 39 acts in a known fashion when it is tilted in vertical direction for adjusting the height of seat and back by corresponding actuation within the telescopic part 15 and by horizontal tilting, as is shown by dashes in FIGS. 7 and 8, for actuating the bracing element 26 by way of interposed gear elements, not shown. The bracing element 26 described is designed to cut out the springiness of the seat 5 entirely when the chair is to be used for certain jobs in which any springiness of the seat would be disadvantageous. The bracing element 26 described could of course alternatively be provided in addition to the adjusting rollers 19 in the chair of FIGS. 5 and 6.

We claim:

1. In a chair having a seat part integrally joined to a back part and defining a one-piece bucket seat with a flexible bending region at the location of joining of the seat and back parts, said bucket seat being attached to a chair frame support structure, the improvement comprising:

(a) the bending region of the bucket seat has a width as measured from opposite sides of the seat and back parts thereof;

(b) the seat part includes longitudinal slots extending from the opposite sides of the bending region toward the front thereof; and (c) the area of the seat and back parts located laterally between the slots is of continuous solid construction.

2. A chair according to claim 1, characterized in that:

(a) that the one-piece bucket is fixed to the chair frame by overlay and attachment of the front end of the seat to a crosspiece attached to the chair frame.

3. A chair according to claim 2, characterized in that:

(a) the crosspiece is defined by a plate arranged essentially horizontally.

4. A chair according to claim 2 or 3, characterized in that:

(a) the upper back edge of the plate is rounded off.

5. A chair according to claim 2 or 3, characterized in that:

(a) back legs are provided below the seat of the one-piece bucket, said legs running downward from the crosspiece in only a slightly inclined manner to a location rearward of the bucket seat and then in a downward direction.

6. In a chair having a frame provided with fastening elements in the region of the front edge of the seat part for tilting attachment of seat and back parts, the seat and back parts being capable of moving springily toward and away from one another, the improvement wherein:

(a) the seat part and back part are a one-piece integral structural element joined together centrally of the sides thereof with the width of the seat and back parts being reduced in the transition region between seat and back in relation to the width of the remaining portions of the seat and back parts for intensifying springy displaceability between seat and back parts; and (b) the seat part is firmly fixed only at the front end thereof so the seat and back parts as a unit are capable of springy swinging about the front edge of the seat.

7. A chair according to claim 6, characterized in that:

(a) for additional intensification of the springy displaceability between the seat and back parts, slots run forward in the sitting direction from the sides of the seat in the area of reduced width.

8. A chair according to any one of claims 1, 2 or 3, characterized in that:

(a) the chair frame includes a vertically disposed telescopic part for adjustably supporting the seat part at different heights; and (b) a forklike fastening element is attached to the upper end of the telescopic part and includes at least two prongs extending to the front end of the seat part and attached thereto.

9. A chair according to claim 8, characterized in that:

(a) in addition to the attachment of the ends of the prongs of the forklike fastening elements to the seat part, there is provided a bracing element, displaceable in the sitting direction, between the seat and the prongs.

10. A chair according to claim 9, characterized in that:

(a) the displaceable bracing is defined by support rollers capable of rolling along on the prongs and connected together by means of a common axle.

11. A chair according to claim 10, characterized in that:

(a) a second bracing element for engaging against the rear region of the seat part is extendably attached to the telescopic part of the chair frame.

12. In a chair having a frame provided with fastening elements in the region of the front edge of the seat part for tilting attachment of seat and back parts, the seat and back parts being capable of moving springily toward and away from one another, the improvement wherein:

(a) the seat part and back part are a one-piece integral structural element;

(b) the seat part is firmly fixed only at the front end thereof so that seat and back parts as a unit are capable of springy swinging about the front edge of the seat;

(c) the chair frame includes a vertically disposed telescopic part for adjustably supporting the seat part at different heights; and (d) a forklike fastening element is attached to the upper end of the telescopic part and includes at least two prongs extending to the front end of the seat part and attached thereto.

13. A chair according to claim 12, characterized in that:

(a) the width of the seat and back parts is reduced in the transition region between seat and back in relation to the width of the remaining portions of the seat and back parts for intensifying springy displaceability between seat and back parts.

14. A chair according to claim 12, characterized in that:

(a) for additional intensification of the springy displaceability between the seat and back parts, slots run forward in the sitting direction from the sides of the seat in the area of reduced width.

* * * * *